United States Patent [19]

Chartrain et al.

[11] Patent Number: 4,910,370

[45] Date of Patent: Mar. 20, 1990

[54] MICROWAVE OVEN HAVING A PRE-PROGRAMMED TIMING DEVICE

[75] Inventors: Pierre Chartrain; Michel G. De Matteis; Bernard M. Bois, all of Cormelles-Le-Royal, France

[73] Assignee: Moulinex (Societe Anonyme), Bagnolet, France

[21] Appl. No.: 335,676

[22] Filed: Apr. 10, 1989

[30] Foreign Application Priority Data

Apr. 21, 1988 [FR] France ..... 88 05315

[51] Int. Cl.[4] ..... H05B 6/68; H01H 43/00

[52] U.S. Cl. ..... 219/10.55 C; 219/10.55 B; 200/50 C

[58] Field of Search ..... 219/10.55 C, 10.55 B, 219/10.55 R, 10.55 D; 200/50 C, 38 FA, 38 F; 307/141.8; 126/197

[56] References Cited

U.S. PATENT DOCUMENTS

| | | | |
|---|---|---|---|
| 3,824,365 | 7/1974 | Tapper | 219/10.55 C |
| 4,539,453 | 9/1985 | Miyazaki et al. | 219/10.55 C |
| 4,556,773 | 12/1985 | Yoshiyuki et al. | 219/10.55 C |
| 4,600,826 | 7/1986 | Ishimura | 219/10.55 B |
| 4,629,845 | 12/1986 | Mahon | 219/10.55 B |

*Primary Examiner*—Philip H. Leung
*Attorney, Agent, or Firm*—Young & Thompson

[57] ABSTRACT

A microwave oven has a circuit for controlling the supply of electricity to a generator of microwave energy, the circuit having a main switch and movable contact, the opening of which is controlled by a timer. The control circuit also comprises a by-pass circuit mounted in parallel between two points having a pre-programmed timing device in series with the interrupting switch. A commutating mechanism controlled by a user is adapted to both move circuit switch to its open position and to move the interrupting switch to a closed position in which a timing device operates to allow the supply of electricity to the microwave generator.

6 Claims, 1 Drawing Sheet

MICROWAVE OVEN HAVING A PRE-PROGRAMMED TIMING DEVICE

BACKGROUND OF THE INVENTION

The invention relates to microwave ovens comprising a circuit for controlling the supply of electricity to a generator of microwave energy, which circuit is connected to the terminals of a voltage supply comprising a main interrupting switch operated by an operating lever which is movably mounted on a control panel, a movable contact which is normally closed, mounted in series with the switch and the opening of which is controlled by a timer connected to the terminals of the network by means of the movable contact, by means of which timer the user can adjust the total duration of the supply of electricity to the generator of microwaves, and also a circuit switch, mounted in series in the control circuit, which is normally in the closed position when a door of the oven is closed and is ready to be used.

Nowadays it has been established that the user employs his microwave oven not only for conventional type cooking operations, but also to meet his daily requirements such as the preparation of breakfasts and reheating a plate containing a prepared food which is becoming cold. Now, although in the first case setting of the timer for a sufficiently long period does not require great precision and presents no difficulty, the same does not apply in the second case, since the user must adjust the timer very precisely around a very small value, of the order of a minute for example.

The particular aim of the invention is to eliminate this difficulty in controlling the timing.

SUMMARY

According to the present invention there is provided a microwave oven comprising a circuit for controlling the supply of electricity to a generator of microwave energy, which circuit is connected to the terminals of a voltage supply, comprising a main switch operated by an operating lever which is movably mounted on a control panel, a movable contact mounted in series with the switch, the opening of which is controlled by a timer connected to the terminals of the network by means of the movable contact, and by means of which the user can adjust the total duration of the supply of electricity to the generator of microwaves, and also a circuit switch, mounted in series in the control circuit, which is in a closed position when a door of the oven is closed, wherein the control circuit also comprises, in a by-pass circuit mounted in parallel between two points situated on either side of a section of the control circuit comprising the movable contact and the circuit switch, a pre-programmed timing device which is mounted in series with an interrupting switch, the said interrupting switch being operated by a commutating mechanism controlled by the user and being adapted to move, on the one hand, the said circuit switch from its closed position to its open position, in which the timer no longer controls the supply of electricity to the microwave generator, and to move, on the other hand, the interrupting switch from its open position, in which the timing device is not in use, to a closed position in which the timing device operates to allow the supply of electricity to the microwave generator.

Thus the operation of using the microwave oven for a short and precise period is performed automatically, and maybe repeated with certainty during the time when the timing device is preprogrammed.

DESCRIPTION OF THE PREFERRED EMBODIMENT

Figure 1:
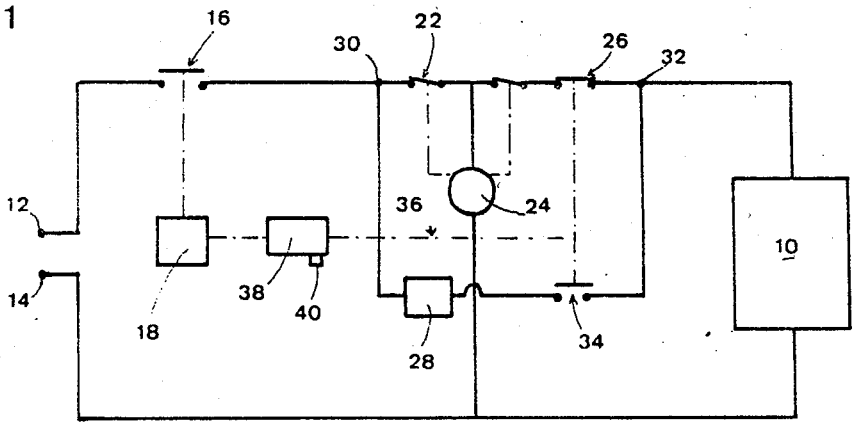
FIG. 1 is a diagram of a circuit assembly for controlling the supply of electricity to a generator of microwave energy, which circuit is constructed according to the invention and is intended to be incorporated in a microwave oven.

The electrical diagram shown in FIG. 1 shows a circuit for controlling the supply of electricity to a generator of microwave energy 10 intended to equip a microwave oven and to be connected to the terminals 12 and 14 of an alternating voltage supply. This control circuit comprises in a known way a main switch 16 operated by an operating lever 18 which is movably mounted on a control panel schematically shown as 20 in FIG. 2, a movable contact 22 which is normally closed, which is mounted in series with the switch 16 and the opening of which is controlled by an electromechanical timer 24 connected to the terminals 12, 14 of the network by means of its own contact 22, which timer the user can regulate to define the total duration of the supply of electricity to the generator of microwaves 10, and also a circuit switch 26, mounted in series in the control circuit with the switch 16 and the contact 22, which circuit switch 26 is normally in the closed position into which it is brought by a known means when the door of the oven is closed, and the oven is ready for use.

The control circuit also comprises a pre-programmed timing device 28 which is mounted in series with an interrupting switch 34 in a by-pass circuit mounted in parallel between two electrical nodes 30 and 32 situated on each side of a section of the control circuit comprising the movable contact 22 and the circuit switch 26, the said interrupting switch 34 being operated by a commutating mechanism 36 controlled by a push lever 38 which can be operated by the user and which is movably mounted for this purpose on the control panel 20 between an inactive position (FIG. 2) and an engaged position, the said commutating mechanism 36 being adapted to move, on the one hand, the said switch 26 from its normally closed position to its open position, in which the timer 24 no longer controls the supply of electricity 10 to the microwave generator, and to move, on the other hand, the interrupting switch 34 from its open position, in which the timing device 28 is not in use, to a closed position in which the said device 28 operates to allow the supply of electricity to the microwave generator 10.

The pre-programmed timing device 28 is preferably an electronic timing device of known type, the timing period of which can be adjusted around a small value of the order of a minute, for example between thirty seconds and one minute and thirty seconds, by means of a potentiometer forming part of the timing device 28, the control knob 40 of which is mounted on the push-lever 38.

Figure 2:
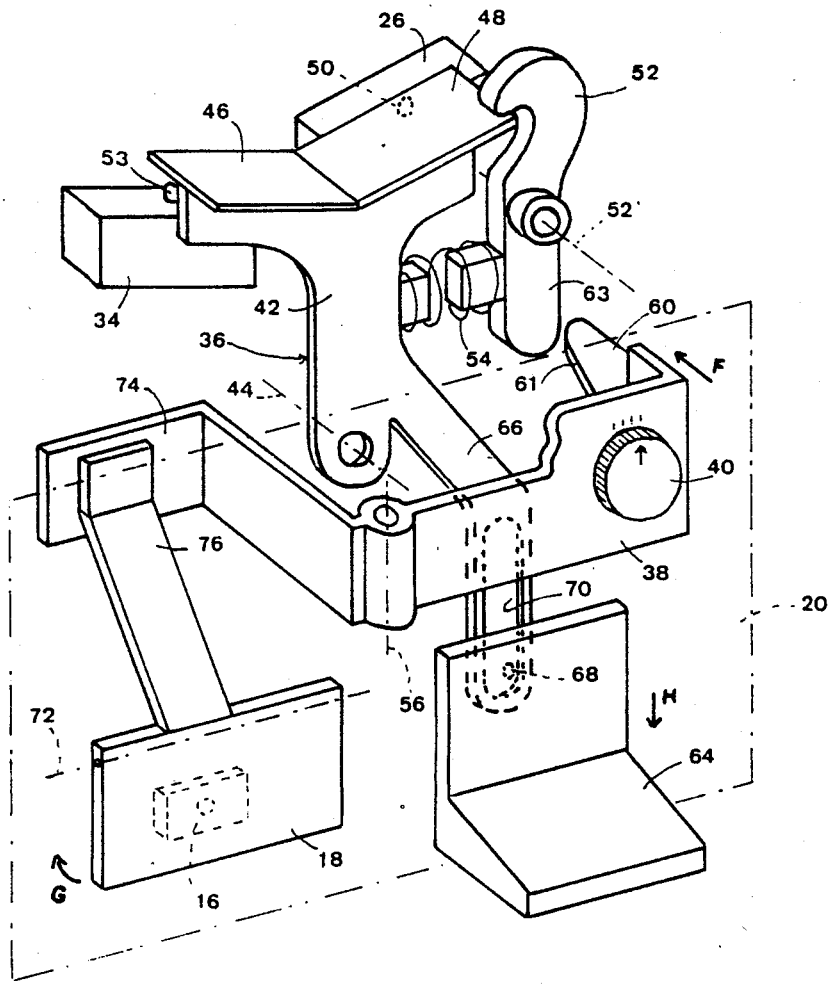
FIG. 2 is a perspective view of a commutating mechanism coupled on the one hand, to electrical components of the control circuit in FIG. 1 and, on the other hand, to the mechanical components necessary for the operation of the microwave oven, and mounted on the control panel of this oven.

As shown in FIG. 2, the commutating mechanism 36 comprises a rocking device 42 substantially in the shape of a two-pronged fork, mounted to pivot about a horizontal axis 44 disposed transversely to the control panel 20 between a cocked position, in which one of the prongs 48 of the fork 42 bears on the contact 50 for the circuit switch 26 to move it into its normal closed position, in which cocked position it is held by a hook 52 mounted on the said control panel 20 to be movable about a horizontal axis 52' disposed transversely to the control panel 20, and an operating position in which the other prong 46 acts on the contact 53 for the interrupting switch 34 to move it into its closed position, towards which it is driven by an elastic return means 54, such as a spring, when the hook 52 has been unhooked from the tooth 48 by means of the push-lever 38. For this purpose the push-lever 38 has the general shape of a plate articulated to pivot about a vertical axis 56 and comprises in its operating zone a cam 60 directed horizontally towards the hook, the active part 61 of which cam is adapted to engage with the free end 63 of the said hook to cause, on the one hand, unhooking of this hook 52 when the push-lever 38 is operated and, on the other hand, pivoting of the rocking device 42 from its cocked position to its operating position.

In order to make the switching on of the oven and/or triggering of the timing device 28 operate automatically, the operating lever 18 for the main switch 16 is mounted to pivot about a horizontal axis 72 parallel to the control panel 20 and the push-lever 38 comprises a heel 74 situated facing a tongue 76 integral with the said operating lever, which heel engages with the said tongue 76, when the push-lever 38 is operated by the user, in order to cause pivoting of the operating lever 18 about the axis 72 and thus closure of the main switch 16.

For the sake of clarity, the operation of the electrical and mechanical components of the control device of this oven will be recapitulated in detail hereinafter for the case where the user wishes to switch on the oven for a very brief period by means of the preprogrammed timing device 28.

In order to obtain this type of heating, the user, after having adjusted the timing device 28 by means of the knob 40, in order to control the energy dose suitably for preparation of the chosen food, pushes on the push lever 38 in the direction of the arrow F in FIG. 2. This depression of the push lever 38 causes unhooking of the hook 52 as a result of the action of the cam 60 on the free end 63 of this hook, releasing the tooth 48 and allowing the rocking device 42 to pivot under the action of the spring 54 interPosed between the end 63 and this rocking device 42.

In the course of this pivoting, the circuit switch 26 opens and the contact 34 closes, thus causing, not only by-passing of the section of circuit 30 - 32 and the disconnection of the timer 24, but also connection of the timing device 28 which then controls the supply of electricity to the microwave generator, and causing almost simultaneously, on the other hand, automatic closing of the main switch 16 by means of the operating lever 18 whose tipping in the direction of the arrow G (FIG. 2) is caused by entrainment of the tongue 76 by the heel 74 resulting from the pivoting of the push lever 38 about the articulation axis 56.

It will be understood that once the countdown of the timing device 28 has ended, the electronic timing device passes, in a known way, into a non-conducting state in which current in the by-pass circuit is cut and consequently the supply of electricity to the microwave generator 10 is interrupted.

From this time, the user can open the door (opening mechanism not shown) by exerting a downward pressure on the handle 64, in the direction of the arrow H, which drives the stud 68 to the bottom of the opening 70, and as a result causes pivoting of the rocking device 42 towards its re-cocking position, until the tooth 48 is hooked by the hook 52 driven back by the spring 54, and simultaneously causes the return of the push lever 38 into its inactive position shown in FIG. 2.

We claim:

1. A microwave oven comprising a control panel having an operating lever movably mounted thereon, a generator of microwave energy, a circuit for controlling the supply of electricity to said generator of microwave energy, said circuit being adapted to be connected to a voltage supply and comprising a main switch operatively controlled by said operating lever, a movable contact mounted in series with said main switch, a timer adapted to control the opening of said movable contact and adapted to be connected to a said voltage supply by means of said movable contact, said timer comprising user-actuated adjusting means for selecting a desired duration of electricity supply to said generator of microwave energy, a circuit switch mounted in series in said circuit and being in a closed position when the door of the oven is closed, wherein said circuit further comprises a by-pass circuit mounted in parallel between two electrical nodes situated on each side of a section of said circuit comprising the movable contact and the circuit switch, said by-pass circuit comprising a pre-programmed timing device and an interrupting switch mounted in series in the by-pass circuit with said preprogrammed timing device, said control panel further comprising a commutating mechanism movably mounted thereon and cooperable with said interrupting switch and said circuit switch, said commutating mechanism being controlled by the user and being adapted to move from a first position in which said circuit switch is closed and said interrupting switch is open, to a second position in which said circuit switch is open and said interrupting switch is closed, thereby to enable user-actuated control of electricity supply to said generator of microwave energy by either said timer or said preprogrammed timing device as controlled by said commutating mechanism.

2. A microwave oven according to claim 1, wherein the commutating mechanism comprises: a rocking member substantially in the shape of a two-pronged fork, mounted for pivotal movement about a horizontal axis transverse to said control panel from a cocked position, in which one of said prongs of the fork closes said circuit switch to an operating position in which the other said prong of the fork closes said interrupting switch; a hook movably mounted on said control panel, said hook holding said rocking member in said cocked position, an elastic return means urging said rocking member towards said operating position; and a push-lever movably mounted on said control panel, said push-lever unhooking said rocking member responsive to actuation by the user.

3. A microwave oven according to claim 2, further comprising a handle for opening the door of the oven, siad handle being movably mounted on siad control panel, and wherein said rocking member comprises an attachment acted on by said handle to pivot siad rocking member to its cocked position held by said hook.

4. A microwave oven according to claim 2, wherein siad push-lever comprises a plate mounted for pivotal movement about a vertical axis, and wherein said hook is mounted for pivotal movement about a horizontal axis and has a free end, said push-lever comprising a cam directed horizontally towards said hook, said cam having an active part adapted to engage with said free end of said hook to cause unhooking of this hook from said rocking member when the push-lever is operated so that siad rocking member pivots from its cocked position to its operating position.

5. A microwave oven according to claim 2, wherein said operating lever is mounted for pivotal movement about a horizontal axis, said operating lever comprising a tongue and said push-lever comprising a heel adjacent said tongue, said tongue engaging said heel responsive to operation of said push-lever by the user, thereby to cause pivoting of the operating lever and thus closure of the main switch.

6. A microwave oven according to claim 2, wherein said pre-programmed timing device comprises an electronic timer having a timing period adjustable to values of the order of a minute by means of a potentiometer, said electronic timer further comprising a control knob mounted on said push-lever, said electronic timer changing to a non-conducting state upon expiration of a time set on set control knob, thereby to cut off current in the by-pass circuit.

* * * * *